US008763217B2

(12) United States Patent
Kaneko

(10) Patent No.: US 8,763,217 B2
(45) Date of Patent: Jul. 1, 2014

(54) BUCKLE

(75) Inventor: Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 57 days.

(21) Appl. No.: 13/121,771

(22) PCT Filed: Oct. 3, 2008

(86) PCT No.: PCT/JP2008/068052

§ 371 (c)(1),
(2), (4) Date: Mar. 30, 2011

(87) PCT Pub. No.: WO2010/038308

PCT Pub. Date: Apr. 8, 2010

(65) Prior Publication Data

US 2011/0173783 A1 Jul. 21, 2011

(51) Int. Cl.
*A44B 11/25* (2006.01)

(52) U.S. Cl.
USPC ..... 24/615; 24/625

(58) Field of Classification Search
USPC ..... 24/614, 615, 625, 629, 193, 197
See application file for complete search history.

(56) References Cited

U.S. PATENT DOCUMENTS

| | | | | |
|---|---|---|---|---|
| 5,355,562 | A | 10/1994 | Matoba et al. | |
| 5,465,472 | A * | 11/1995 | Matoba | 24/625 |
| 7,650,676 | B2 * | 1/2010 | Saitsu | 24/615 |
| 2002/0040514 | A1 * | 4/2002 | Uehara et al. | 24/614 |
| 2005/0132545 | A1 | 6/2005 | Anscher | |
| 2005/0235470 | A1 * | 10/2005 | Uehara | 24/615 |
| 2007/0186394 | A1 * | 8/2007 | Hsiao | 24/614 |
| 2008/0178438 | A1 * | 7/2008 | Yoshie et al. | 24/616 |
| 2009/0007397 | A1 * | 1/2009 | Hsin | 24/306 |

FOREIGN PATENT DOCUMENTS

| | | | |
|---|---|---|---|
| CN | 1103770 | A | 6/1995 |
| CN | 1628568 | A | 6/2005 |
| CN | 101228980 | A | 7/2008 |
| DE | 19837071 | A1 | 9/2001 |
| JP | 06-038619 | U | 5/1994 |
| JP | 2005-177454 | A | 7/2006 |
| JP | 2008-178570 | A | 8/2008 |

OTHER PUBLICATIONS

International Search Report, PCT Application No. PCT/JP08/068052, mailed Nov. 4, 2008.
Office Action, Chinese Patent Application No. 200880131303.X, mailed Sep. 20, 2012.

* cited by examiner

*Primary Examiner* — Robert J Sandy
*Assistant Examiner* — Michael Lee
(74) *Attorney, Agent, or Firm* — Kilpatrick Townsend & Stockton LLP

(57) ABSTRACT

A buckle includes a male member and a female member. The male member includes: a base to which a string member is attachable; a pair of legs that project from the base and are elastically deformable in directions intersecting an insertion direction of the male member; and engaging portions that are provided to the legs and are engageable with the female member. When the male member is inserted into the female member, parts of the legs come into contact with inner walls of the female member to form biasing portions that bias the male member in an opposite-insertion direction using a resilience of the legs.

4 Claims, 8 Drawing Sheets

BUCKLE

This application is a national stage application of PCT/JP2008/068052, which is incorporated herein by reference.

TECHNICAL FIELD

The present invention relates to a buckle that includes a male member and a female member. Specifically, the invention relates to a buckle that is used to connect and disconnect both ends of a string member or the ends of two string members.

BACKGROUND ART

For some buckles used to connect and disconnect both ends of a string member or the ends of the two string members, there has been suggested an arrangement capable of preventing rattling of a socket and a plug inserted in the socket (see, for instance, Patent Literature 1).

In this case, a buckle includes a plug and a socket. The plug includes a plug body, a pair of legs that project from both lateral ends of the plug body in parallel with each other, and a guide bar that projects in parallel with the pair of legs from a position between the pair of legs. The outer lateral sides of the legs are provided with engagement grooves that are opened in an opposite-insertion direction. A spring is integrally provided to the distal end of the guide bar in parallel with the legs. The socket includes a cylindrical socket body, openings provided to both lateral walls of the socket body such that the legs of the plug are exposed outside, and engaged portions that are provided to the lateral walls to which the openings are provided and are respectively engaged with the engaging grooves of the plug.

In the arrangement, in order to engage the plug with the socket, the legs of the plug are inserted into the socket. While being inserted into the socket, the distal ends of the legs are each elastically deformed inward by both lateral walls of the socket. Simultaneously, the spring is gradually compressed. When the engaging grooves of the legs pass the engaged portions of the socket, the legs, which have been elastically deformed inward, are elastically recovered outward. At this time, when the insertion of the plug is stopped, the plug is biased in the opposite-insertion direction by the resilience of the compressed spring, so that the engaging grooves of the legs are engaged with the engaged portions, respectively.

In order to disengage the plug from the socket, the plug is pushed into the socket and, then, the legs of the plug exposed out of the openings of the socket are pushed inward, thereby disengaging the engaging grooves from the engaged portions. In this state, the plug is pushed out of the socket with the assistance of the resilience of the spring. Thus, the plug can be disengaged from the socket.

Patent Literature 1: DE19837071A1

DISCLOSURE OF THE INVENTION

Problems to be Solved by the Invention

In a buckle having the above arrangement, since the spring provided to the plug generates a biasing force in the opposite-insertion direction acting on the plug to prevent rattling of the plug, there are some problems as follows.

Specifically, the spring has to be integrally provided to the distal end of the guide bar, which results in complication in the arrangement and a difficulty in manufacturing. In addition, when the plug is not inserted, the spring, which projects from the distal end of the guide bar, can easily catch clothes or the like.

An object of the invention is to provide a buckle capable of solving the above problems and preventing rattling of a plug and socket without complicating the arrangement thereof.

Means for Solving the Problems

According to an aspect of the invention, a buckle includes: a male member; and a female member into which the male member is inserted for engagement, in which the male member includes: a base to which a string member is attachable; a pair of legs that project from the base and are elastically deformable in directions intersecting an insertion direction of the male member; and engaging portions that are respectively provided to the legs and are engageable with the female member, and when the male member is inserted into the female member, parts of the legs come into contact with inner walls of the female member to form biasing portions that bias the male member in an opposite-insertion direction using a resilience of the legs.

In each of the biasing portions, at least one of the contact portions, i.e., the part of the leg or the inner wall and the female member, is provided with a slant surface, a curved surface or the like that extends in the opposite-insertion direction so as to bias the male member in the opposite-insertion direction using the resilience of the leg.

In the above arrangement, when the pair of legs of the male member are inserted into the female member, the legs partly contact with the inner walls of the female member. The biasing portions provided to such contact portions bias the male member in the opposite-insertion direction using the resilience of the legs. Thus, the male member and the female member contact with each other, thereby preventing rattling of the male member and the female member.

Accordingly, it is only necessary to provide the parts of the legs or the inner walls of the female member with the biasing portions that bias the male member in the opposite-insertion direction using the resilience of the legs. Rattling of the male member and the female member (i.e., rattling in the insertion direction and opposite-insertion direction) can be prevented with such a simple arrangement.

In the above aspect, it is preferable that the biasing portions are defined by: male-side abutment portions that are provided to outer lateral sides of distal ends of the legs; and a pair of female-side abutment portions that are provided to the inner walls of the female member and contact with the male-side abutment portions, respectively, and the pair of female-side abutment portions are formed as wall surfaces that extend in the opposite-insertion direction while getting distanced from each other.

In the above arrangement, when the male-side abutment portions provided to the outer lateral sides of the distal ends of the legs contact with the female-side abutment portions provided to the inner walls of the female member, respectively, the male-side abutment portions are guided along the wall surfaces of the female-side abutment portions in directions in which the male-side abutment portions are distanced from each other (i.e., in the opposite-insertion direction) with the assistance of the resilience of the legs, thereby smoothly biasing the male member in the opposite-insertion direction.

In the above aspect, it is preferable that the pair of female-side abutment portions are formed as slant wall surfaces that extend in the opposite-insertion direction while getting distanced from each other, and the male-side abutment portions have wall surfaces adapted to plane-contact with the slant wall surfaces of the female-side abutment portions.

In the above arrangement, the female-side abutment portions are formed as slant wall surfaces, which can be easily formed. Further, the male-side abutment portions have the wall surfaces adapted to plane-contact with the slant wall surfaces of the female-side abutment portions, so that the arrangement is excellent in abrasion resistance.

In the above aspect, it is preferable that the female member includes: an insertion opening through which the pair of legs of the male member are inserted; a guide that elastically deforms the distal ends of the pair of legs inserted through the insertion opening in directions in which the distal ends approach each other and, when the male member is inserted to a predetermined position, elastically recovers the distal ends of the pair of legs in directions in which the distal ends are distanced from each other; and a pair of engaged portions with which the engaging portions are respectively engaged when the male member is inserted to the predetermined position, the engaged portions have engaged wall surfaces that intersect the insertion direction of the male member, the engaging portions have engaging wall surfaces that contact with the engaged wall surfaces, respectively, and when the male member is biased in the opposite-insertion direction by the biasing portions, the engaging wall surfaces are in contact to be engaged with the engaged wall surfaces, respectively.

In the above arrangement, the engaged portions have the engaged wall surfaces that intersect the insertion direction of the male member and the engaging portions have the engaging wall surfaces that contact with the engaged wall surfaces, respectively. When the male member is biased in the opposite-insertion direction by the biasing portions, the engaging wall surfaces are in contact to be engaged with the engaged wall surfaces, respectively, thereby preventing easy disengagement.

In other words, when the male member is biased in the opposite-insertion direction by the biasing portions, the engaging wall surfaces of the engaging portions are in contact to be engaged with the engaged wall surfaces intersecting the insertion direction of the male member. In this state, when a force to pull the male member from the female member (i.e., a force in the opposite-insertion direction) is applied to the male member, the applied force is received by both the engaged wall surfaces and the engaging wall surfaces intersecting the insertion direction of the male member, thereby preventing easy disengagement.

In the above aspect, it is preferable that the engaged wall surfaces are formed as slant wall surfaces that extend laterally outward from a center of the female member while slanting toward the insertion opening, and the engaging wall surfaces are formed as slant wall surfaces that extend laterally outward from a center of the male member while slanting toward the base.

In the above arrangement, when a force in the opposite-insertion direction (i.e., a force to cancel engagement) is applied to the male member, the applied force is received by the engaged wall surfaces and the engaging wall surfaces. Since the engaged wall surfaces and the engaging wall surfaces are the slant surfaces extending laterally outward from the center of the male member or the female member while slanting in the opposite-inserting direction, the pair of legs are deformed in the directions in which the pair of legs are distanced from each other by the force in the opposite-insertion direction applied to the male member. As a result, the engagement strength between the male member and the female member is increased, thereby more reliably preventing easy disengagement.

In the above aspect, it is preferable that the engaging wall surfaces are provided to the distal ends of the legs adjacently to the male-side abutment portions.

In the above arrangement, since the engaging wall surfaces and the male-side abutment portions are adjacently provided to the distal ends of the legs, thereby preventing easy disengagement of the engaging wall surfaces from the engaged wall surfaces and, thus, providing a stable engagement therebetween.

BEST MODE FOR CARRYING OUT THE INVENTION

An exemplary embodiment of the invention will be described below with reference to the drawings.

Exemplary Embodiment

Overall Arrangement

Figure 1:
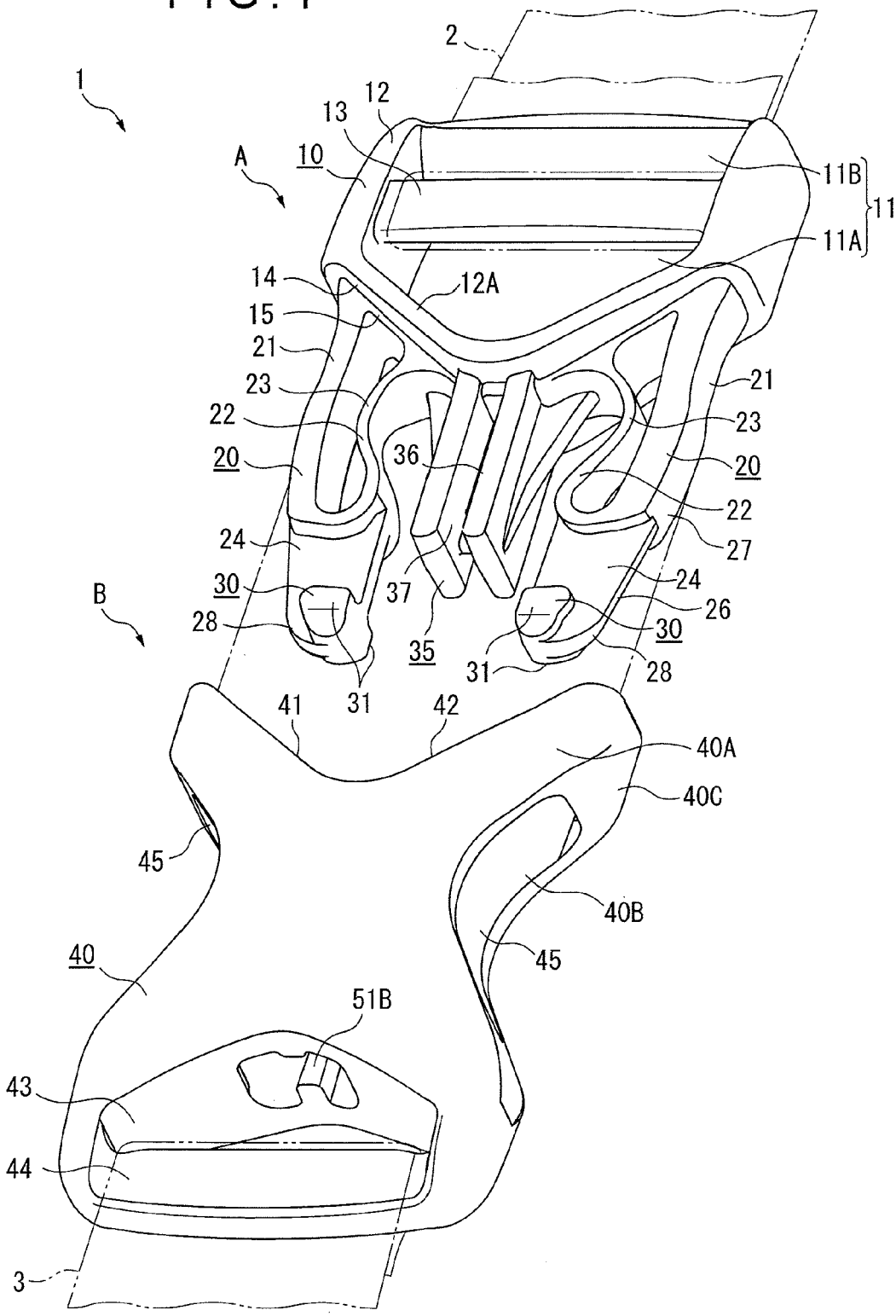
FIG. 1 is an exploded perspective view showing a buckle according to an exemplary embodiment of the invention.
Figure 2:
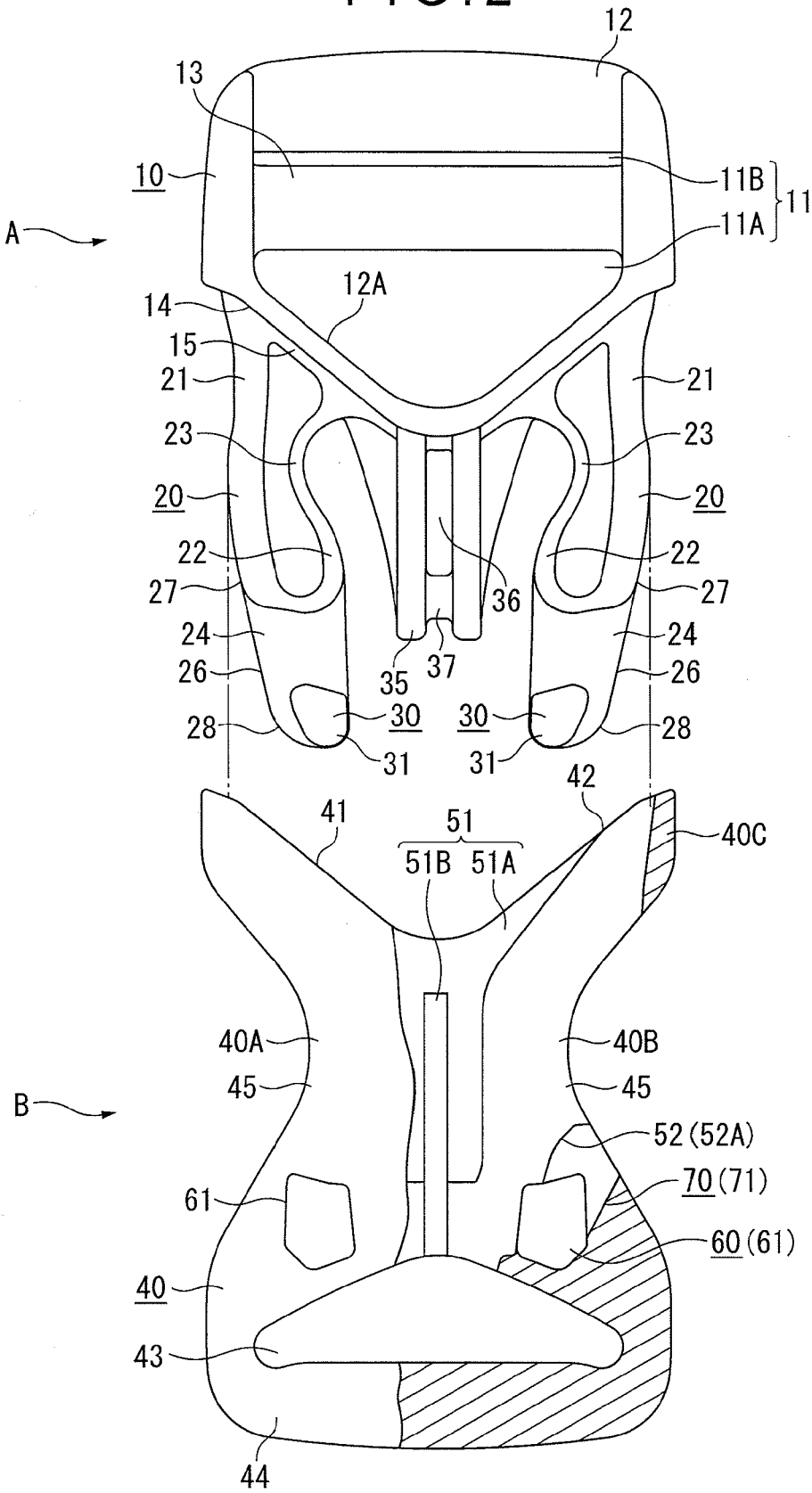
FIG. 2 is a plan view showing the buckle according to the above exemplary embodiment in disengagement.
Figure 3:
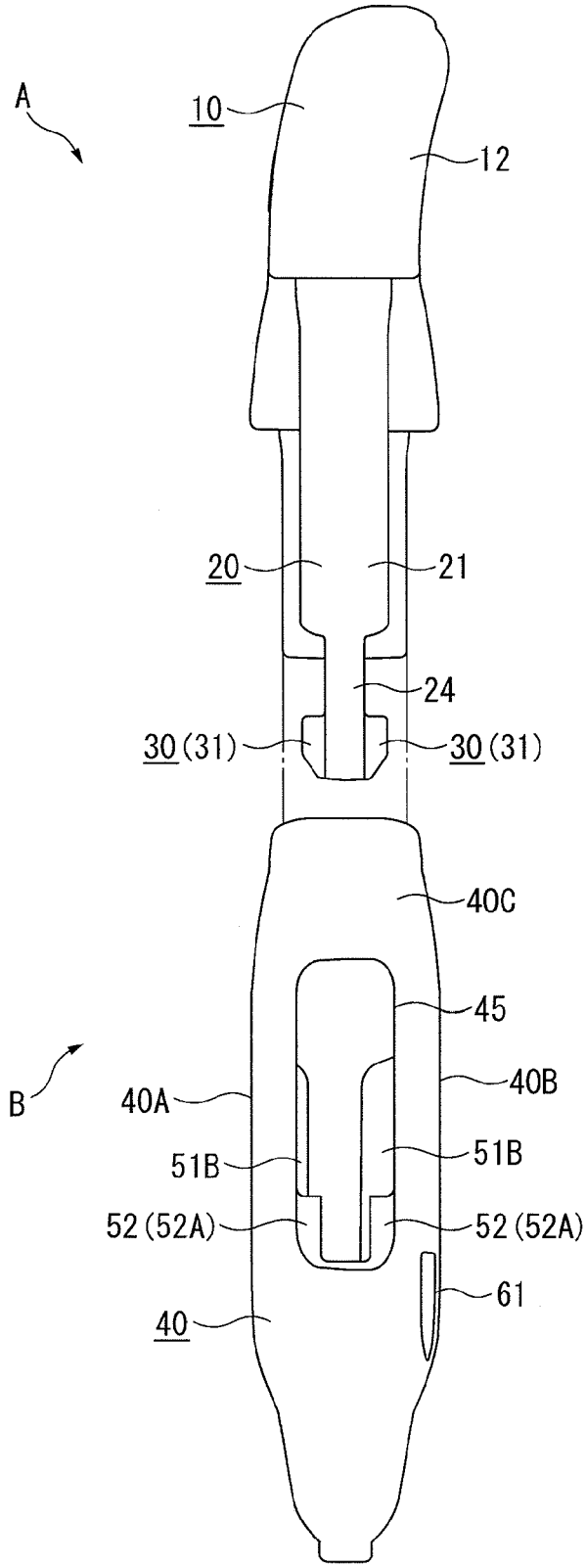
FIG. 3 is a side view showing the buckle according to the above exemplary embodiment in disengagement.
Figure 4:
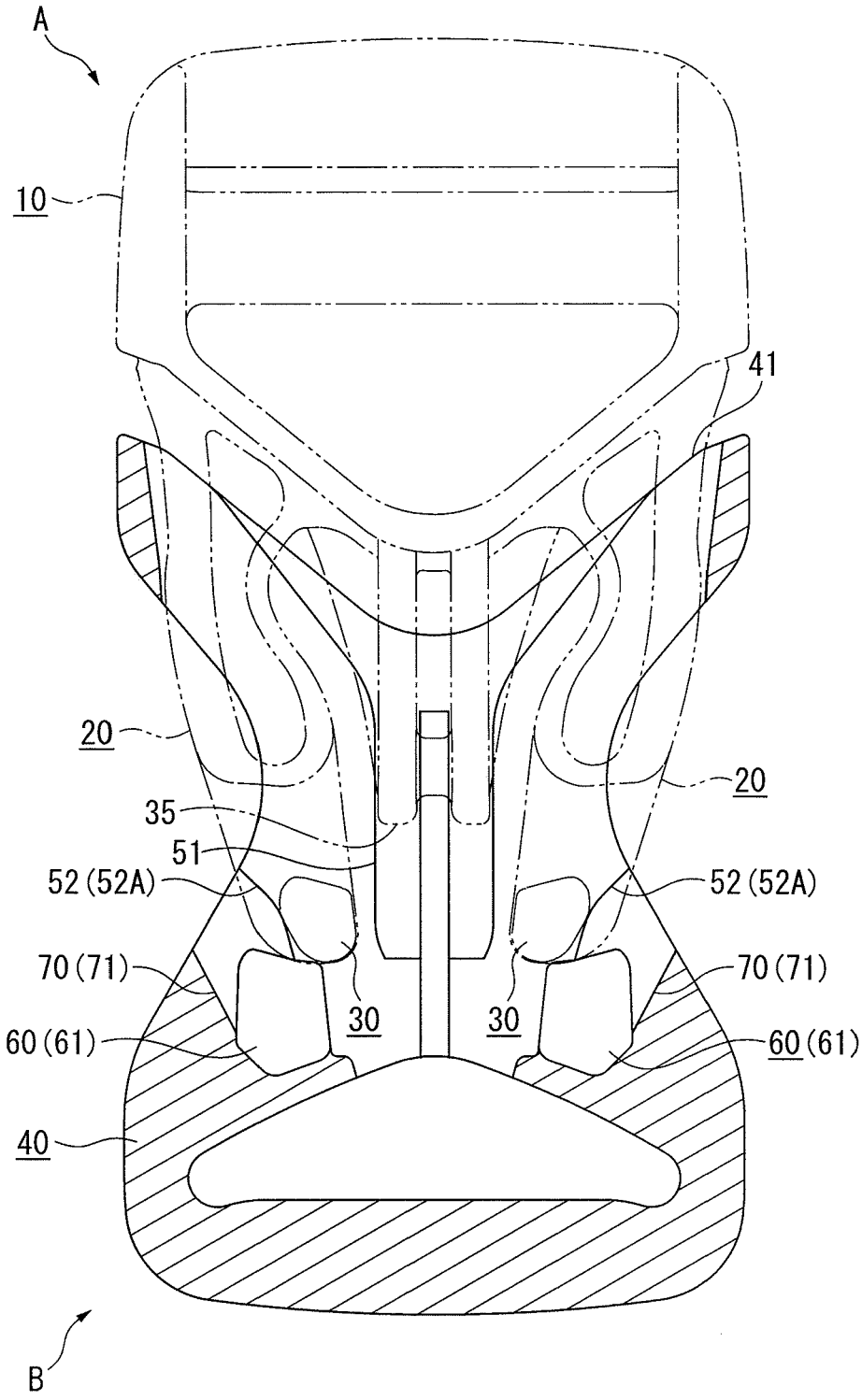
FIG. 4 illustrates insertion of a plug into a socket according to the above exemplary embodiment.

FIG. 1 is an exploded perspective view of a buckle according to this exemplary embodiment. FIG. 2 is a plan view showing the buckle in disengagement. FIG. 3 is a side view showing the buckle in disengagement. FIG. 4 illustrates insertion of a plug into a socket.

As shown in FIGS. 1 to 4, a buckle 1 according to this exemplary embodiment is used to connect and disconnect ends 2 and 3 of a string member. The buckle 1 includes a male member A integrally formed of synthetic resin and a female member B also integrally formed of synthetic resin. The male member A is inserted into the female member B to be engaged with the female member B. Materials of the male member A and female member B are not limited to synthetic resin, but may be other any other material such as metal.

Male Member

The male member A includes: a base 10 to which a string member is attachable; a pair of legs 20 that project in parallel with each other from both lateral ends of the base 10 (i.e., ends defined in a direction perpendicular to an insertion direction of the male member A) and are elastically deformable in directions intersecting the insertion direction of the male member A (specifically, in directions substantially perpendicular to the insertion direction) to be closer to or distanced from each other; an engaging portion 30 that is provided to the distal end of each of the legs 20 for engagement with the female member B; and a single guide bar 35 that projects from a lateral center of the base 10 between the legs 20 in parallel with the legs 20.

The base 10 includes: a substantially pentagonal frame 12 that has in the middle thereof a string attachment hole 11 (a string attachment portion) into which the end 2 of the string member is inserted to be engaged; and a butting portion 14 that is defined in a frame member 12A from which the legs 20 project.

A connecting bar 13 extends in a lateral direction of the frame 12 across the string attachment hole 11 in the middle of the string attachment hole 11. The connecting bar 13 partitions the string attachment hole 11 into two holes, i.e., a string attachment hole 11A defined on a front side relative to the insertion direction near the legs 20 and a string attachment hole 11B defined on a rear side opposite to the front side relative to the insertion direction. Thus, the string member can be inserted into the string attachment holes 11A and 11B and folded around the connecting bar 13, thereby adjusting the length of the string member.

The frame member 12A of the frame 12, which is provided with the legs 20, is formed as the butting portion 14 relative to the female member B. The butting portion 14 is formed in a V-shape having a center projecting farther in a projecting direction of the legs 20 relative to both ends of the frame member 12A. A fitting projection 15A is provided to the same surface of the frame member 12A as the legs 20 are provided. The fitting projection 15 has a contour slightly smaller than the outer circumference of the frame member 12A and slightly projects in the projecting direction of the legs 20.

Each of the legs 20 includes: an outer leg piece 21 and an inner leg piece 22 that are elastically deformable in the directions substantially perpendicular to the insertion direction of the male member A; and a distal guide piece 24 that extends from the distal ends of the outer leg piece 21 and the inner leg piece 22. The inner leg piece 22 is closer to the center than the outer leg piece 21.

The outer leg piece 21 substantially linearly extends in the insertion direction of the male member A from the lateral end of the base 10 in such a manner that the outer leg piece 21 is slightly bulged outward at a middle position toward the distal end and then curved inward in a gentle arc.

A base end of the inner leg piece 22 is located substantially at the middle of the oblique side of the butting portion 14. In other words, the base end of the inner leg piece 22 is located closer to the distal end of the leg 20 than the base end of the outer leg piece 21. The inner leg piece 22 has a bent portion 23 between the base end and distal end thereof. When the leg 20 is deformed inward, the bent portion 23 is further bent and, when the leg 20 is deformed outward, the bent portion 23 is straightened to restrict outward deformation of the outer leg piece 21 at a certain level or more. Specifically, the bent portion 23 is formed in a shape in which the bent portion 23 extends from the base end toward the distal end substantially perpendicularly to the oblique side of the butting portion 14 while approaching toward the outer leg piece 21, and, once coming close to the outer leg piece 21, curves away from the outer leg piece 21 and again curves toward the outer leg piece 21. The thickness in an inward/outward deformation direction of the inner leg piece 22 is thinner than that of the outer leg piece 21.

The distal guide piece 24 is formed in a shape in which the distal guide piece 24 is gradually narrowed while extending forward from a distal connecting portion connecting the outer leg piece 21 and the inner leg piece 22. The distal guide piece 24 has engaging portions 30 formed on top and bottom surfaces of the distal end thereof, respectively. The engaging portions 30 project from the top and bottom surfaces of the distal guide piece 24, respectively. An insertion guide surface 26 and an operating portion 27 are formed in the middle of an outer edge of the distal guide piece 24 and an outer edge of the outer leg piece 21 that is continuous with the outer edge of the distal guide piece 24. In addition, a male-side abutment portion 28 is formed in the outer lateral side of the distal end of the distal guide piece 24. In other words, the engaging portions 30 and the male-side abutment portion 28 are adjacently provided to a distal end surface of the leg 20.

The engaging portions 30 of each of the pair of legs 20 include protrusions 31 that project from the top and bottom surfaces of the distal guide piece 24, respectively.

Each of the protrusions 31 is formed in a distorted square shape having surrounding walls such as an inner lateral wall 31A, a front wall 31B, an outer lateral wall 31C and a rear wall 31D, in which the corners of adjacent ones of these walls are connected by arcuate surfaces. The inner lateral wall 31A is located along an inner lateral surface of the distal guide piece 24. The inner lateral wall 31A is formed as a wall surface substantially parallel with the insertion direction of the male member A. The front wall 31B is formed as a wall surface substantially perpendicular to the insertion direction of the male member A. The outer lateral wall 31C is formed as a slant wall surface that extends from the front wall 31B in an opposite-insertion direction of the male member A while gradually getting distanced from the inner lateral wall 31A. The rear wall 31D serves as an engaging wall surface and is formed as a slant wall surface that extends from the rear end of the inner lateral wall 31A toward the outer lateral wall 31C while slanting in the opposite-insertion direction.

The guide bar 35, which projects from the distal end of the butting portion 14 in parallel with the pair of legs 20, has an elongated hole 36 formed at the center thereof and guide grooves 37 formed on the top and bottom surfaces thereof. Both the elongated hole 31 and the guide grooves 37 are formed along a longitudinal direction of the guide bar 35.

Female Member

The female member B includes a flat square-cylinder shaped female member body 40 having a top wall 40A (a top surface), a bottom wall 40B (a bottom surface), and a pair of lateral walls 40C connecting the top wall 40A and the bottom wall 40B.

An end of the female member body 40 is provided with an insertion opening 41 into which the pair of legs 20 of the male member A are inserted and a butting portion 42 that comes into contact with the butting portion 14 of the male member A. The butting portion 42 is formed in a V-shape corresponding to that of the butting portion 14 of the male member A, so that the fitting projection 15 of the male member A can be fitted to the insertion opening 41.

The other end of the female member body 40 (i.e., an end opposite to the insertion opening 41) has a string attachment hole 43 and a connecting bar 44 (a string attaching portion) where the end 3 of the string member is inserted to be held. In addition, in the middle of the lateral walls 40C, openings 45 are formed by cutting in a concave shape toward the centers of the top wall 40A and the bottom wall 40B. The outer lateral sides of the middle portions of the legs 20 of the male member A (i.e., the operating portions 27) are exposed out of the openings 45, so that each of the legs 20 can be pressed inward.

The female member body 40 is provided therein with a first guide 51 that guides the guide bar 35, second guides 52 that guide the distal ends of the pair of legs 20, engaged portions 60 with which the engaging portions 30 are engaged, and biasing portions 70 that, when the male member A is inserted into the female member B, bias the male member A in the opposite-insertion direction using an outward resilience of the legs 20 to bring the male member A and the female member B into contact with each other, thereby preventing rattling of the male member A and the female member B (i.e., rattling in the insertion direction or the opposite-insertion direction).

The first guide 51 includes a guide groove 51A that is defined by the inner surfaces of the top wall 40A and the bottom wall 40B of the female member body 40 to guide the guide bar 35, and a guide strip 51B that projects from the inner surfaces of the top wall 40A and the bottom wall 40B of the female member body 40 to guide the guide grooves 37 of the guide bar 35. The guide groove 51A tapers in width from the insertion opening 41 toward the inside of the female member body 40 but, then, extends with a constant width to the middle of the inside of the female member body 40.

When the male member A is inserted through the insertion opening 41 of the female member body 40, the second guides 52 guide the engaging portions 30 of the pair of legs 20 of the male member A and, simultaneously, elastically deform the pair of legs 20 in directions in which the distal ends of the pair of legs 20 approach each other. When the male member A is inserted to a predetermined position, the second guides 52 elastically recover the distal ends of the pair of legs 20 in directions in which the distal ends of the pair of legs 20 are distanced from each other. Specifically, the second guides 52 project from the inner surfaces of the top wall 40A and the bottom wall 40B of the female member body 40, and are provided with guide wall surfaces 52A (female-side abutment portions), with which the male-side abutment portions 28 come into contact, respectively. The guide wall surfaces 52A are formed as slant wall surfaces that extend in the opposite-insertion direction while gradually getting distanced from each other, i.e., while slanting away from each other.

Figure 5:
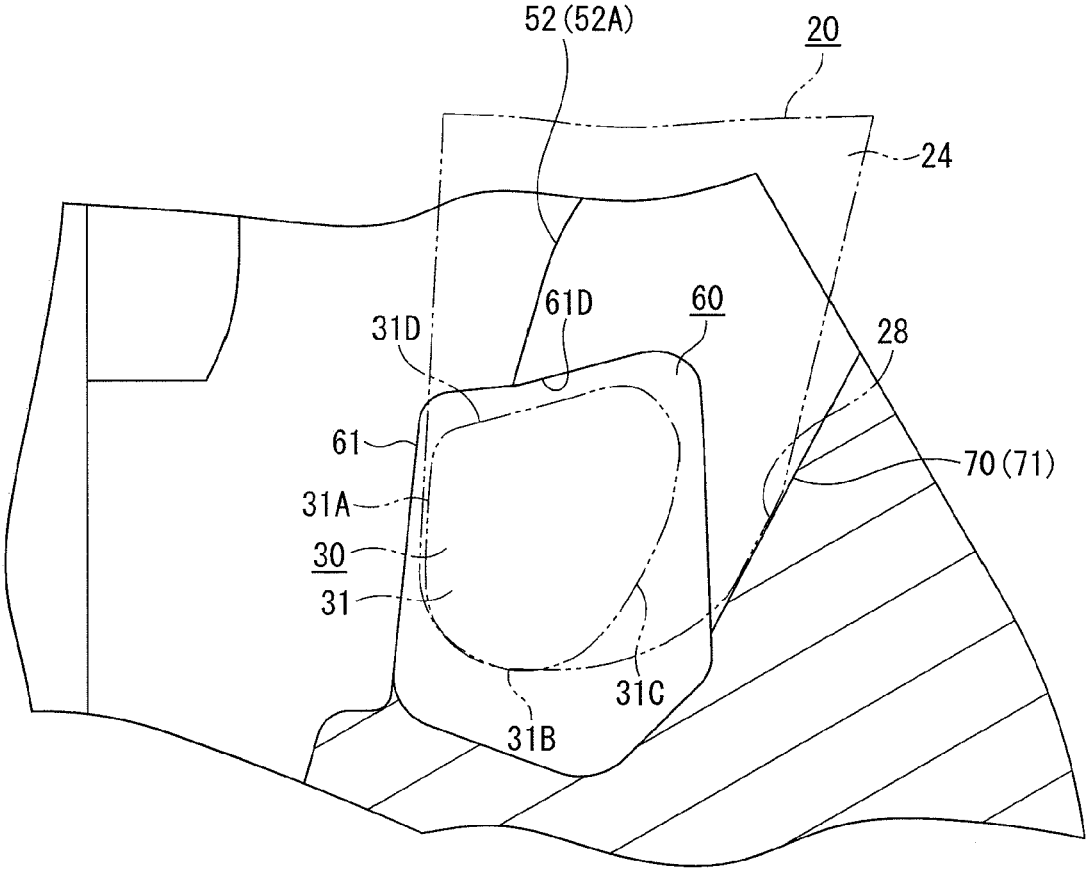
FIG. 5 illustrates a state before engagement of the plug with the socket according to the above exemplary embodiment.

Each of the engaged portions 60 is continuously provided to the innermost of the step-shaped second guide 52 projecting from the inner surfaces of the top wall 40A and the bottom wall 40B. In other words, as shown in FIG. 5, each of the engaged portions 60 is defined in a recess 61 that is dented in the inner surface of the top wall 40A or the bottom wall 40B of the female member body 40, the recess 61 extending outward from the innermost of the guide wall surface 52A. The engaged portion 60 includes an engaged wall surface 61D (i.e., a wall surface defined at the opposite-insertion direction side among walls surfaces defined in the recess 61). The engaging portion 30 is in contact to be engaged with the engaged wall surface 61D.

The rear wall 31D of the engaging portion 30, which faces the butting portion 14 of the base 10, is engaged with the engaged wall surface 61D. The engaged wall surface 61D, which intersects the insertion direction of the male member A, is formed as a slant wall surface slanting in the opposite-insertion direction outwardly from the center. A through hole is opened in the external surface of the bottom wall 40B, the through hole being continuous with the recess 61 formed in the bottom wall 40B. The through hole serves as an insertion hole for a mold (slide core) used to form the engaged wall surface 61D. Such a through hole may also be opened in the external surface of the top wall 40A for the recess 61 formed in the top wall 40A.

At the innermost of the female member body 40, the biasing portions 70 are defined in female-side abutment portions 71. Each of the female-side abutment portion 71 is formed in the inner surface of the lateral wall 40C located outward beyond the engaged portion 60 at the innermost of the female member body 40. The leg 20 of the male-side abutment portion 28 comes into contact with the female-side abutment portion 71. The female-side abutment portions 71 are formed as slant wall surfaces extending in the opposite-insertion direction while getting distanced from each other. When the male member A is inserted to the predetermined position inside the female member B and, then, the distal ends of the pair of legs 20 start to be elastically recovered outward, the male-side abutment portions 28 of the male member A come into contact with the female-side abutment portions 71 before completion of the elastic recovery. The slant wall surfaces of the female-side abutment portions 71 bias the male member A in the opposite-insertion direction, so that the engaging portions 30 of the male member A are engaged with the engaged portions 60 of the female member B, respectively. In other words, the rear walls 31D of the male member A are in contact to be engaged with the engaged wall surfaces 61D of the female member B, respectively. The male-side abutment portions 28 are adapted to plane-contact with the middles of the slant wall surfaces of the female-side abutment portions 71, respectively.

Engagement Operation

When the pair of legs 20 of the male member A are inserted into the female member B through the insertion opening 41 of the female member B, the guide bar 35 is guided by the first guide 51 and the engaging portions 30 of the legs 20 are guided by the second guides 52, as shown in FIG. 4. At this time, when the engaging portions 30 of the legs 20 come into contact with the guide wall surfaces 52A of the second guides 52, the engaging portions 30 are elastically deformed in the directions in which the distal ends of the pair of legs 20 approach each other in conjunction with the insertion of the male member A.

When the engaging portions 30 reach the engaged portions 60 beyond the guide wall surfaces 52A, as shown in FIG. 5, the engaging portions 30 are moved in the directions in which the engaging portions 30 are distanced from each other with the assistance of the resilience of the pair of legs 20 and, thus, fitted into the recesses 61, respectively. At this time, before completion of the elastic recovery of the legs 20, the male-side abutment portions 28 in the distal ends of the legs 20 come into contact with the female-side abutment portions 71 of the biasing portions 70, respectively.

The female-side abutment portions 71 are formed as the slant wall surfaces that extend in the opposite-insertion direction of the male member A while slanting away from each other. In other words, the female-side abutment portions 71 (the slant wall surfaces) are formed in the inner walls of the female member body 40 with which the male-side abutment portions 28 in the distal ends of the legs 20 come into contact. Thus, the resilience of the legs 20 laterally acts on the female-side abutment portions 71 through the male-side abutment portions 28.

Figure 6:
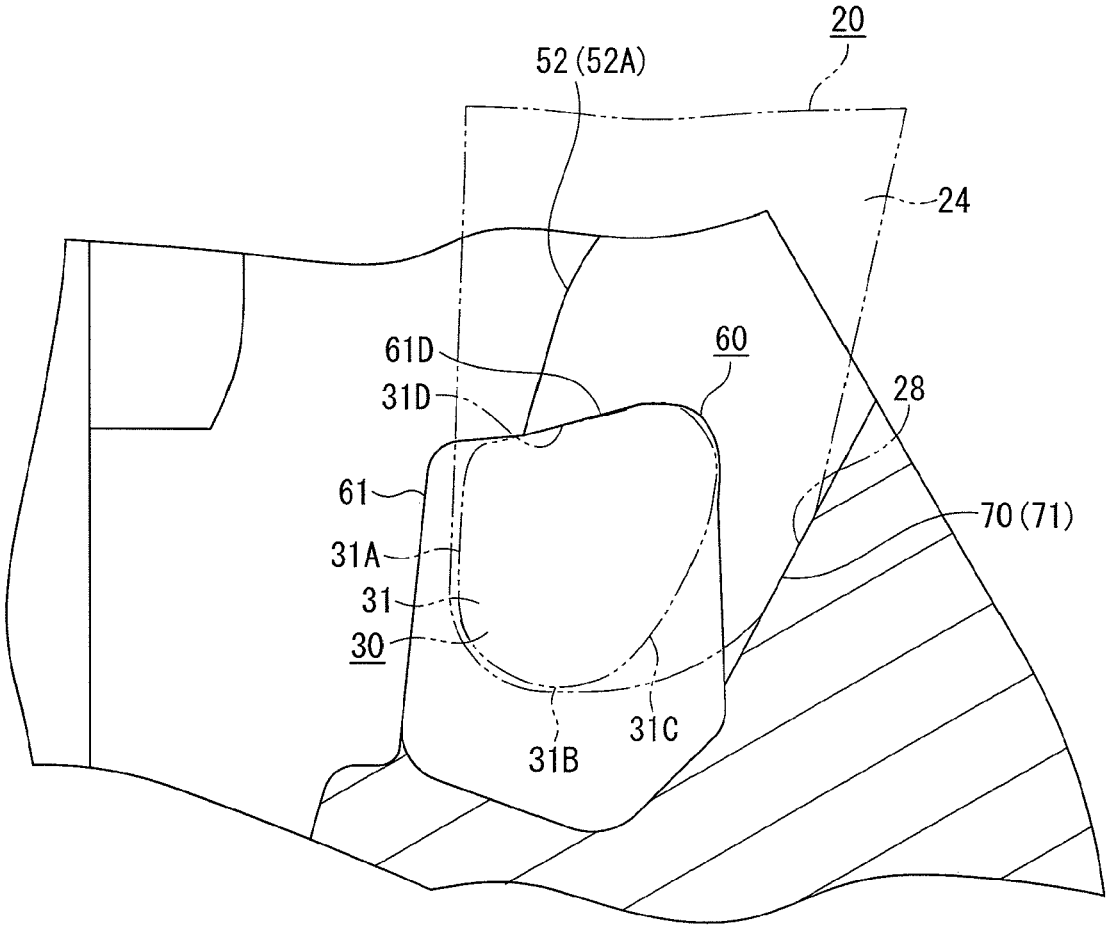
FIG. 6 illustrates a state after engagement of the plug with the socket according to the above exemplary embodiment.

As a result, as shown in FIG. 6, since the male-side abutment portions 28 in the distal ends of the legs 20 are moved in slanting directions of the female-side abutment portions 71 (i.e., in the opposite-insertion direction of the male member A), the engaging wall surfaces (the rear walls 31D) of the male member A are in contact to be engaged with the engaged wall surfaces 61D of the female member B. Thus, no clearance is formed in the opposite-insertion direction (pull-out direction) of the male member A between the engaging portions 30 and the engaged portions 60, thereby preventing rattling resulting from the clearance.

Incidentally, the male member A is preferably biased in the opposite-insertion direction by the biasing portions 70 when the male member A and the female member B are completely engaged with each other, but the arrangement of the invention is not limited thereto. No biasing force may be required as long as the engaging wall surfaces 31D and the engaged wall surfaces 61D are in contact with each other.

At this time, the male-side abutment portions 28 are formed as the wall surfaces plane-contacting with the slant wall surfaces of the female-side abutment portions 71 at the middles (preferably, around the centers) of the slant wall surfaces, so that the arrangement is excellent in abrasion resistance.

In the engagement of the male member A with the female member B, when a force to pull the male member A out of the female member B (i.e., a force in the opposite-insertion direction) is applied to the male member A, the applied force is received by the engaged wall surfaces 61D and the engaging wall surfaces (the rear walls 31D), both intersecting the inserting diction of the male member A, thereby preventing easy disengagement. In particular, when the force in the opposite-insertion direction is applied to the male member A, the applied force is received by the engaged wall surfaces 61D and the engaging wall surfaces (the rear walls 31D). The engaged wall surfaces 61D and the engaging wall surfaces (the rear walls 31D) are the slant surfaces, each of which extends laterally outward from the center of the male member A or the female member B while slanting in the opposite-insertion direction. Thus, the pair of legs 20 are deformed to be distanced from each other with the assistance of the force applied to the male member A in the opposite-insertion direction. As a result, since the engagement strength between the male member A and the female member B is increased, thereby further reliably preventing easy disengagement.

Further, since the engaging wall surfaces (the rear walls 31D) and the male-side abutment portions 28 are adjacently provided to the distal ends of the legs 20, the engaging wall surfaces (the rear walls 31D) cannot be easily disengaged from the engaged wall surfaces 61D, resulting in a stable engagement.

Disengagement Operation

In order to disengage the male member A from the female member B, the operating portions 27 of the legs 20 exposed out of the openings 45 of the female member B are pushed inward. Then, the legs 20 of the male member A are elastically deformed inward.

Consequently, the engaging portions 30 are disengaged from the engaged portions 60. In this state, by pulling the male member A out of the female member B, the male member A can be disengaged from the female member B.

Modifications

It should be noted that the invention is not limited to the buckle having the arrangement of the exemplary embodiment but encompasses following modifications.

In the above exemplary embodiment, the engaging portions 30 of the male member A are engaged with the engaged portions 60 that are provided to the innermost relative to the insertion opening 41 of the female member B. However, the arrangement is not limited thereto.

Figure 7:
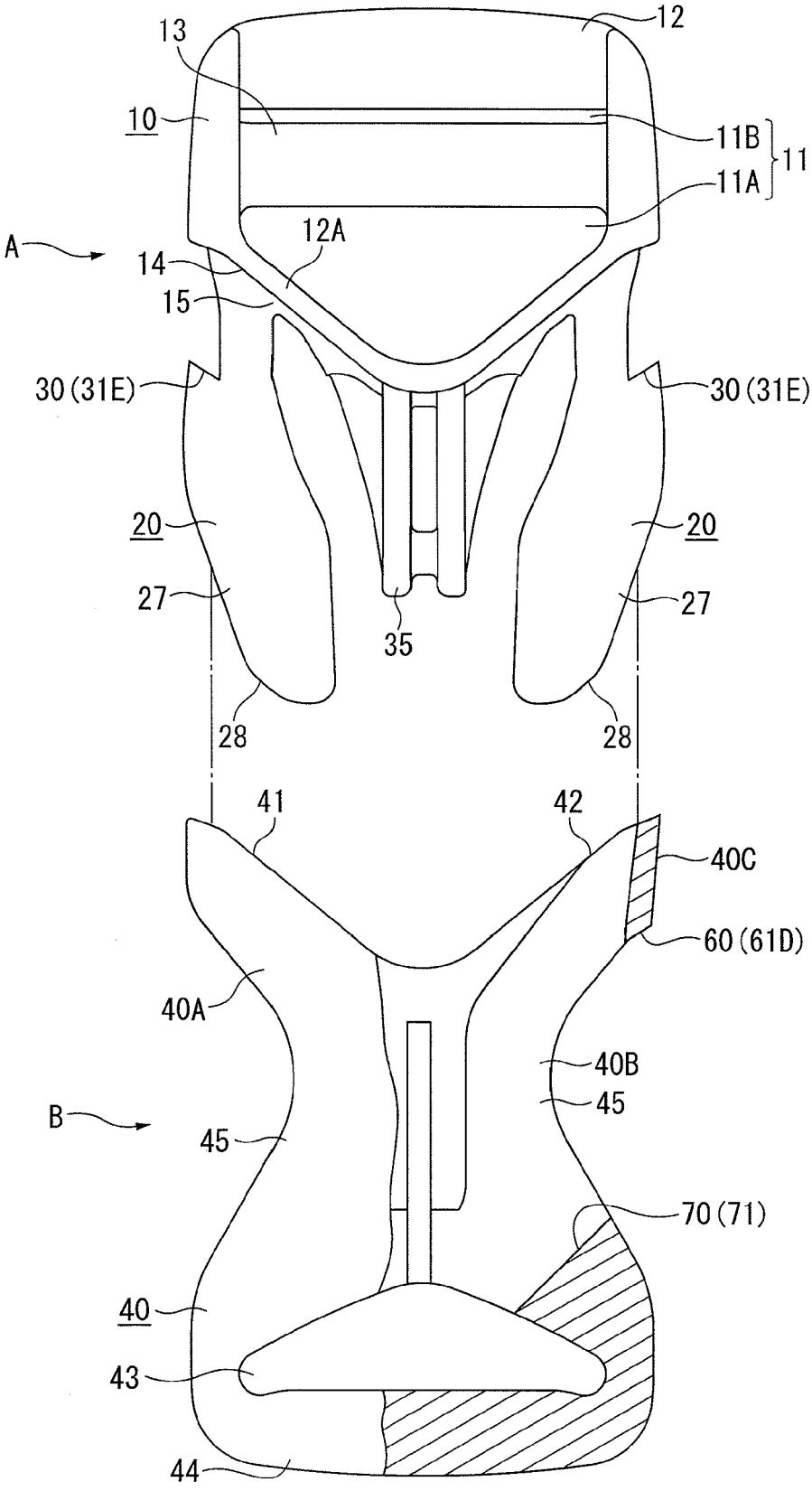
FIG. 7 is a plan view showing a buckle according to a modification of the invention in disengagement.
Figure 8:
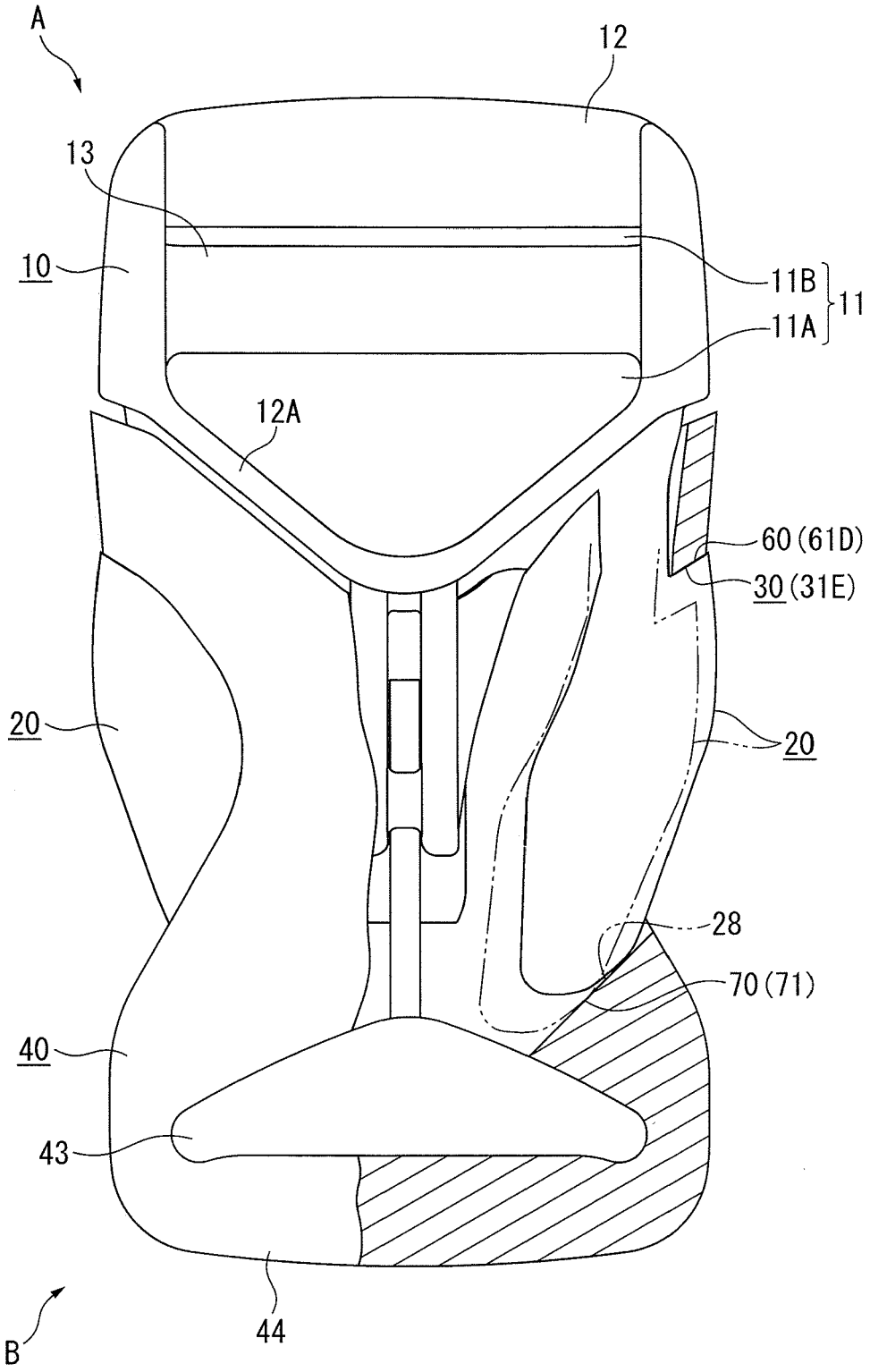
FIG. 8 illustrates insertion of a plug into a socket according to the modification.

For instance, as shown in FIGS. 7 and 8, the engaging portions 30 may be provided to base portions of the pair of legs 20 of the male member A and the engaged portions 60 may be provided to the lateral walls 40C of the female member B having the openings 45. Each of the engaging portions 30 includes an engaging wall surface 31E being formed by cutting the outer side of the base portion of the leg 20, the engaging wall surface 31E extending outward while slanting in the opposite-insertion direction. Each of the engaged portions 60 includes an engaged wall surface 61D being provided to the lateral walls 40C of the female member B having the openings 45, the engaged wall surface 61D extending outward while slanting in the opposite-insertion direction.

In this modification, each of the biasing portions 70 includes: the male-side abutment portion 28 that is provided to the outer lateral side of the distal end of the leg 20; and the female-side abutment portion 71 that is formed in the inner wall of the female member B to contact with the male-side abutment portion 28. The female-side abutment portions 71 are formed as the slant wall surfaces extending in the opposite-insertion direction while gradually getting distanced from each other. The male-side abutment portions 28 are shaped such that the male-side abutment portions 28 can plane-contact with the female-side abutment portions 71 at the middles (preferably, around the centers) of the slant wall surfaces.

In this modification, not only the same advantages as those of the above exemplary embodiment can be expected but also the arrangement can be simplified as compared with that of the above exemplary embodiment.

Although the biasing portions 70 are formed in the inner surfaces of the lateral walls 40C located outward beyond the engaged portions 60 at the innermost of the female member body 40 in the above exemplary embodiment, the arrangement is not limited thereto.

For instance, the female member body 40 may be provided therein with the female-side abutment portions 71 as protrusions, and the outer lateral sides of the distal ends of the pair of legs 20 may be provided with the male-side abutment portions 28 as slant wall surfaces that extend in the opposite-insertion direction while gradually getting distanced from each other. When the male-side abutment portions 28 are adapted to contact with the female-side abutment portions 71 in the insertion of the male member A into the female member B, the same advantaged as those of the above exemplary embodiment can be expected due to the male-side abutment portion 28 (the slant wall surfaces).

Although the male member A and the female member B are respectively provided with the string attachment holes 11 and 43 (the string attachment portions) in the above exemplary embodiment, the female member B may not be provided with the string attachment hole 43. In other words, the female member body 40 of the female member B may be fixed directly to another member.

The string member is not limited to a belt string but may be a thin string having a narrow width.

Although the male member A and the female member B are molded (by injection molding or injection compression molding) from synthetic resin in the above exemplary embodiment, the materials are not limited thereto but may be metal or the like.

The invention claimed is:

1. A buckle comprising:

a male member; and a female member into which the male member is inserted for engagement, wherein the male member comprises:

a base to which a string member is attachable;

a pair of legs that project from the base and are elastically deformable in directions intersecting an insertion direction of the male member; and engaging portions that are respectively provided to the legs and are engageable with the female member, the female member comprises:

an insertion opening through which the pair of legs of the male member are inserted;

a guide that elastically deforms the distal ends of the pair of legs inserted through the insertion opening in directions in which the distal ends approach each other and, when the male member is inserted to a predetermined position, elastically recovers the distal ends of the pair of legs in directions in which the distal ends are distanced from each other; and a pair of engaged portions with which the engaging portions are respectively engaged when the male member is inserted to the predetermined position, the engaged portions have engaged wall surfaces that intersect the insertion direction of the male member, the engaged wall surfaces being formed as slant wall surfaces that extend laterally outward from a center of the female member while slanting toward the insertion opening, the engaging portions are provided by a pair of protrusions that project from top and bottom surfaces of a distal end of a guide piece provided at a distal end of each of the legs, each of the protrusions comprising: an inner lateral wall located near an inner lateral surface of the guide piece and being formed as a wall surface substantially parallel with the insertion direction of the male member, a front wall located at the distal end of the guide piece and being formed as a wall surface substantially perpendicular to the insertion direction of the male member; an outer lateral wall formed as a slant wall surface that extends from the front wall in an opposite-insertion direction of the male member while gradually getting distanced from the inner lateral wall; and a rear wall formed as a slant wall surface that extends from a rear end of the inner lateral wall towards the outer lateral wall while slanting in the opposite-insertion direction, the rear wall defining an engaging wall surface to contact with the respective engaged wall surfaces, when the male member is inserted into the female member, parts of the legs come into contact with inner walls of the female member to form biasing portions that bias the male member in an opposite-insertion direction using a resilience of the legs, the biasing portions comprise;

male-side abutment portions that are provided on an outer lateral side of the distal end of each of the legs; and a pair of female-side abutment portions that are provided on the inner walls of the female member and contact the respective male-side abutment portions, and the pair of female-side abutment portions extend in the opposite-insertion direction while getting distanced from each other, and when the male member is biased in the opposite-insertion direction by the biasing portions, the engaging wall surfaces are in contact with the engaged wall surfaces, respectively.

2. The buckle according to claim 1, wherein the pair of female-side abutment portions are formed as slant wall surfaces, and the male-side abutment portions have wall surfaces adapted to plane-contact with the slant wall surfaces of the female-side abutment portions.

3. The buckle according to claim 1, wherein the engaging wall surfaces are provided adjacent to the male-side abutment portions.

4. The buckle according to claim 1, wherein an outer side of the distal end of the guide piece is continuous from the male-side abutment portion to the front wall.

* * * * *

UNITED STATES PATENT AND TRADEMARK OFFICE

CERTIFICATE OF CORRECTION

PATENT NO. : 8,763,217 B2
APPLICATION NO. : 13/121771
DATED : July 1, 2014
INVENTOR(S) : Hitoshi Kaneko It is certified that error appears in the above-identified patent and that said Letters Patent is hereby corrected as shown below:

In the Claims:

In column 11, line 31, In Claim 1, delete "surfaces," and insert -- surface, --, therefor.

Signed and Sealed this
Sixteenth Day of September, 2014

Michelle K. Lee

Michelle K. Lee
*Deputy Director of the United States Patent and Trademark Office*